United States Patent [19]

Lovelace

[11] Patent Number: 4,515,580

[45] Date of Patent: May 7, 1985

[54] BOTTOM SEALING TAB PREBREAKING APPARATUS

[75] Inventor: Harold Lovelace, Saraland, Ala.

[73] Assignee: International Paper Company, New York, N.Y.

[21] Appl. No.: 381,680

[22] Filed: May 25, 1982

[51] Int. Cl.[3] ..... B31B 5/74

[52] U.S. Cl. ..... 493/183; 53/378; 493/452; 493/156

[58] Field of Search ..... 53/374, 375, 378, 379, 53/565, 382; 493/452, 165, 453, 455, 456, 457, 183, 184, 156, 157

[56] References Cited

U.S. PATENT DOCUMENTS

| | | | |
|---|---|---|---|
| 3,002,328 | 10/1961 | Monroe et al. | 53/373 |
| 3,153,374 | 10/1964 | Borkmann et al. | 493/165 |
| 3,166,994 | 1/1965 | Egleston . | |
| 3,289,553 | 12/1966 | Vadas et al. | 493/165 X |
| 3,347,017 | 10/1967 | Allen et al. | 53/379 |
| 3,364,826 | 1/1968 | Austin et al. | 493/165 |
| 3,403,606 | 10/1968 | Gartin | 493/165 |
| 3,408,905 | 11/1968 | Hoff | 493/453 |
| 3,412,922 | 11/1968 | Miller et al. | 229/37 |
| 3,495,507 | 2/1970 | Haas et al. . | |
| 3,593,625 | 7/1971 | Garrett et al. . | |
| 3,604,613 | 9/1971 | Haas et al. | 229/37 R |
| 3,654,842 | 4/1972 | Schwenk . | |
| 4,131,058 | 12/1978 | Graham . | |
| 4,215,522 | 8/1980 | Clift et al. | 53/378 |

*Primary Examiner*—John Sipos
*Assistant Examiner*—Donald R. Studebaker
*Attorney, Agent, or Firm*—Richard J. Ancel; Robert J. Seman

[57] ABSTRACT

A bottom sealing tab breaking method and apparatus for a paperboard carton bottom construction. The invention may be employed with existing apparatus for prebreaking paperboard container bottoms.

9 Claims, 8 Drawing Figures

BOTTOM SEALING TAB PREBREAKING APPARATUS

BACKGROUND OF THE INVENTION

This invention relates to the art of containers, particularly paperboard containers of the type commonly employed for the packaging and storage of liquid foodstuffs, such as milk, orange juice, or the like. The invention relates more specifically to an apparatus for prebreaking the bottom of a container, such as the common gable-top container often employed for the packaging of such foodstuffs.

U.S. Pat. No. 3,412,922 of Nov. 26, 1968, issued to Miller et al discloses a container formed from a single blank of paperboard or the like, the paperboard usually being coated on both sides with a thermoplastic resin to assist in heat sealing during assembly of the container bottom and top and also to seal the paperboard against liquid seepage. The Miller patent discloses a specific bottom construction wherein one flap of two opposed pairs of bottom extension flaps of the blank is provided with a tab. The tab is initially formed by cutting the blank at one of the extension flaps which forms the bottom of the container when the blank is set up and assembled. During formation of the container bottom from the bottom extension flaps, the tab is folded about its fold line or zone of attachment to the bottom flap from which it is formed and is then folded or bent back upon that flap. The purpose of this fold tab construction is to improve the sealing properties of the container by eliminating contact of the container liquid contents with any raw paperboard edges in the carton bottom.

Automatic packing machinery employed for prebreaking the bottom of a container formed from a single paperboard blank is well known. By way of example only, one such apparatus is shown in U.S. Pat. No. 3,593,625 of July 20, 1971, issued to Garrett et al.

SUMMARY OF THE INVENTION

According to the practice of this invention, prior automatic machinery for prebreaking the bottom of a conventional gable-top or other type of container formed from a single blank is modified, so that such machinery may be employed to produce a sealing tab bottom construction for a paperboard container. While the invention is described herein with particular reference to the automatic bottom prebreaking apparatus of the type shown in the Garrett patent, the invention may be employed with any apparatus performing a similar prebreaking function, as for example, U.S. Pat. No. 3,002,328 of Oct. 3, 1961 to Monroe et al, U.S. Pat. No. 3,166,994 of Jan. 26, 1965 to Egleston, U.S. Pat. No. 3,347,017 of Oct. 17, 1967 to Allen et al, and U.S. Pat. No. 4,215,522 of Aug. 5, 1980 to Clift et al.

The full nature of the invention will be understood from the accompanying drawings and the following description and claims.

DETAILED DESCRIPTION OF THE INVENTION

Figure 3:
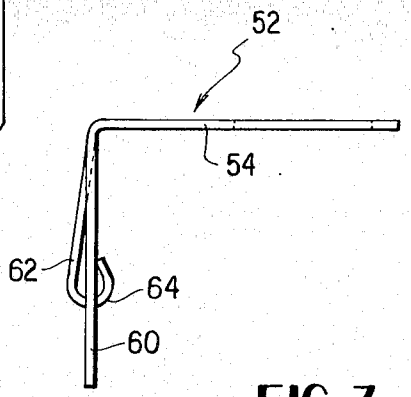
FIG. 3 is a top plan view of the bracket of FIG. 2.
Figure 2:
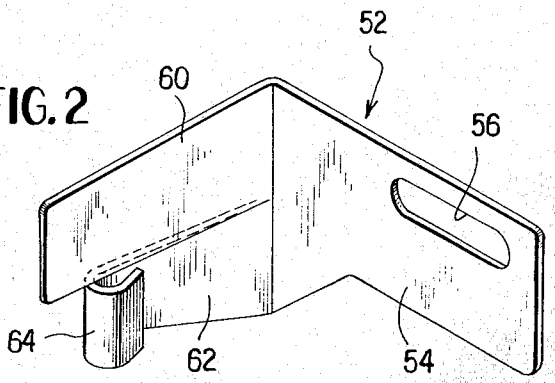
FIG. 2 is a perspective view of the tab prebreaking abutment bracket of this invention.
Figure 1:
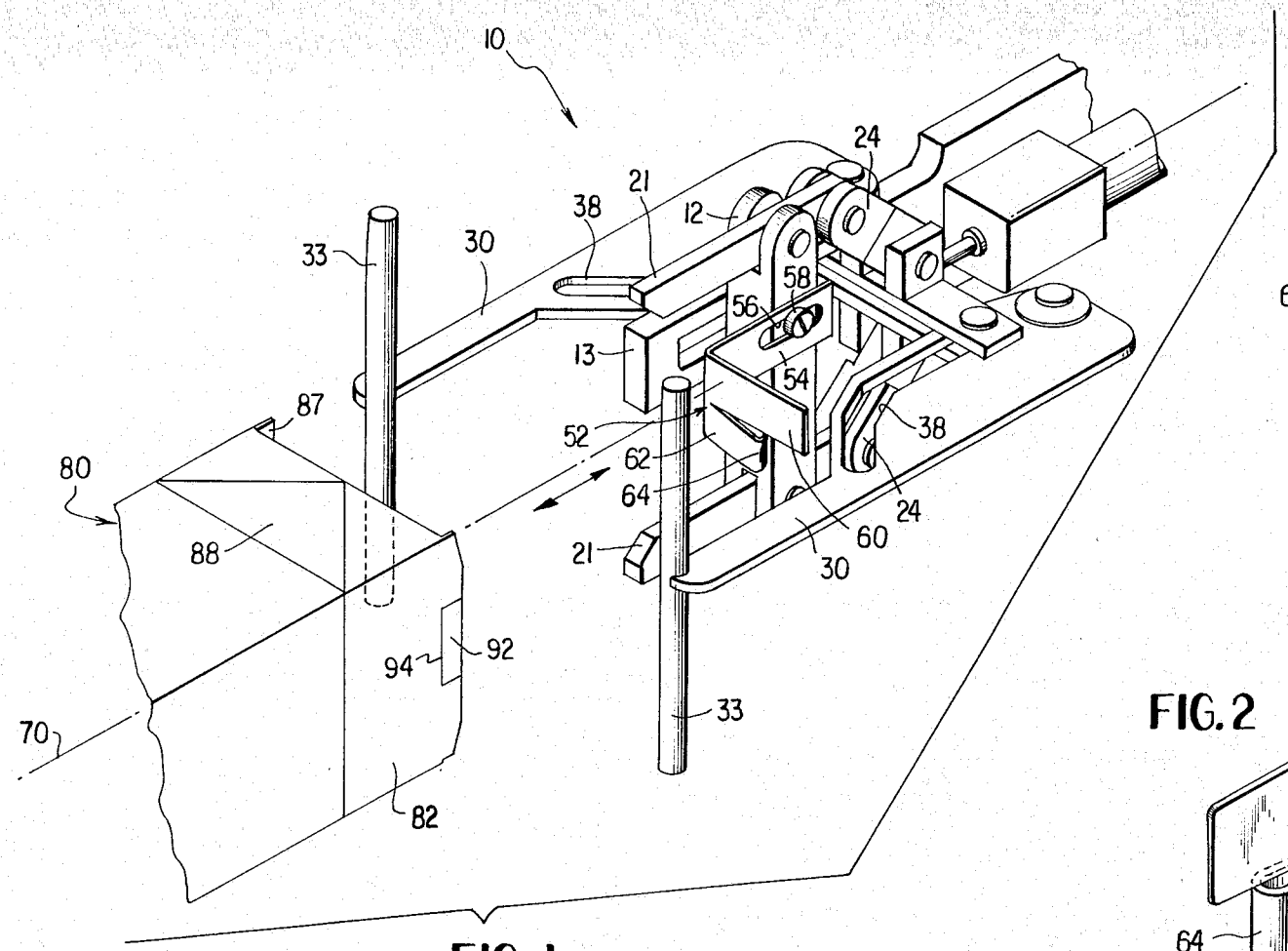
FIG. 1 is a perspective view of a portion of an otherwise conventional machine for prebreaking the bottom scores of a paperboard container, the machine being provided with the tab prebreaking abutment bracket of this invention.

Referring now to FIG. 1 of the drawings, the numeral 10 denotes generally a portion of the bottom prebreaking mechanism of one type of a typical prior art machine for forming containers, the machine being provided with the tab prebreaking abutment bracket of this invention. After the container blank is stamped out and its sides sealed to one another, it is partially erected (set-up) and assumes the form of a tube, square in cross-section. The tube is placed upon and carried by a mandrel. The bottom end forming part of the tube is open, with its bottom forming flaps being coplanar with the sides of the container tube. FIG. 1 shows a part of the container tube 80 and the bottom end forming part thereof.

The numeral 12 denotes a supporting member carried by a reciprocating bar member 13, movable back and forward as indicated by the arrow. The ends of support 12 are bifurcated and pivotally carry two opposed finger elements 21, as in the form of metallic bars. Finger elements 21 are pivotally actuated by levers 24.

The numeral 30 denotes either one of two arms or levers, each provided with cam slots 38 and having, forwardmost (leftmost in FIG. 1) ends which carry rod or bar elements 33. Arms 30 and bars 33 may be conveniently formed of metal stock. During operation, the left (as viewed at FIG. 1) or free ends of the opposed finger elements 21 move periodically towards and away from an imaginary axis 70. This is done upon movement of reciprocating bar member 13 to the left, with subsequent movement of levers 24 to rock finger elements 21 about their pivots on support 12. Bar members 33 similarly move towards and away from axis 70, by virtue of rollers bearing against curved slots 38 in arms 30. The details of the entire construction of the bottom prebreaking apparatus which includes finger elements 21 and bars 33 is not illustrated, such details not being relevant to this invention. Axis 70 coincides with the longitudinal axis of a carton whose bottom is to be prebroken and later formed.

Opposed bottom forming flaps 82 and 86 are moved toward axis 70 by bars 33, while foldable and opposite bottom flap portions 88 and 84 are engaged by the free ends of finger elements 21, moving the former towards axis 70. These actions take place in timed sequence, with bar member 13 moving back and forth during each bottom prebreaking cycle. The carton is removed after the flap folding and bottom prebreaking motions of finger elements 21 and bars 33, the action being cyclically repeated for each carton.

The reader will readily visualize that the finger elements 21 and bars 33 would not alone be suitable for prebreaking the bottom of a sealing tab bottom carton, since merely acting in the described manner on opposed pairs of bottom forming, extension panels or flaps would not cause the sealing tab, shown as element 92 in FIG. 1, to fold back upon the flap 82 from which it is struck (as by cutting), and to thereby form the sealing tab bottom construction.

A bracket leg portion similar to leg portion 60 of bracket 52 is conventionally used with bottom forming apparatus of the type shown in FIG. 1. Its function is to act as an initial carton position stop as the mandrel which carries carton 80 moves the latter into bottom prebreaking location, i.e., into position relative to finger elements 21 and bars 33. Such a bracket leg portion 60 also serves to preclude movement of carton 80, along axis 70 towards the finger elements 21 and bar members 33, during the latter's operation on the bottom flaps.

By the practice of this invention, a carton 80 provided with a bottom sealing tab construction may be pre-broken by the use of automatic machinery. The tab breaking abutment bracket of this invention also exhibits ease of attachment to already existing automatic machinery for setting up cartons. The tab 92 initially lies in the plane of the bottom flap 82 from which it is formed. The tab must be broken out of this plane in order for bottom formation to occur correctly during actions of the machinery later in time. The necessary breaking out and folding back of the tab 92 is initially effected by means of the bracket of this invention. The bracket is generally denoted by the numeral 52 and is conveniently formed of sheet material such as one-sixteenth inch thick aluminum or stainless steel sheet, cut and bent to the illustrated form. The bracket includes a first leg portion 54 having an aperture extending therethrough, such as slot 56, which is carried by the support 12 and attached thereto with a threaded fastener 58 for adjustably supporting the bracket 52 parallel to the axis 70 with respect to support member 12. The second leg of the bracket is defined by two portions 60 and 62 integrally formed from leg 54. Portion 62 includes at its free end a cam or abutment surface 64, here in the form of a bent back curvature. The reader will now visualize that the folding action of the carton bottom forming flaps, by finger elements 21 and bars 33, particularly by one of the bars 33 acting on flap 82, in cooperation with abutment 64 acting on tab 92, will cause the tab 92 to fold or bend outwardly away from its initial position (in the plane of flap 82) so that the carton bottom may be assembled after passing under heaters and folding rails at points later in time.

Figure 5:
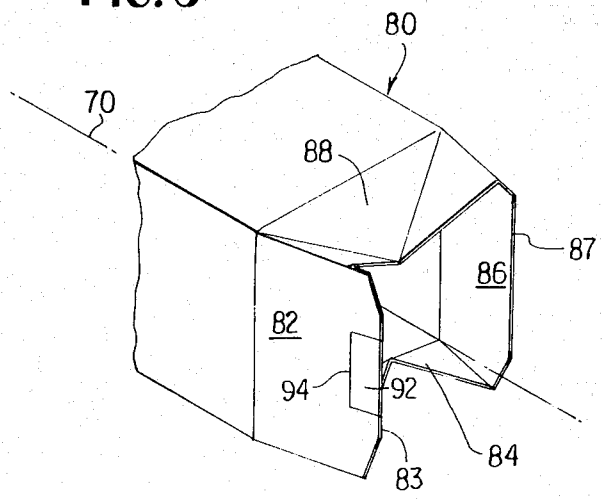
FIGS. 4–6 illustrate the prebreaking of a tab bottom container at various stages, with FIG. 5 illustrating the prebreaking in conjunction with portions of the apparatus illustrated at FIG. 1.
Figure 4:
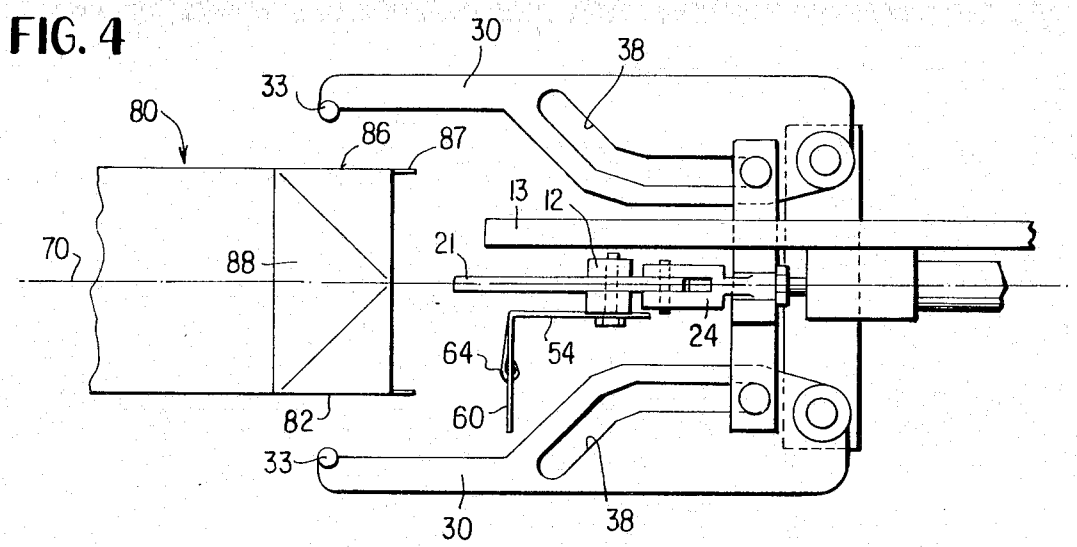
Figure 6:
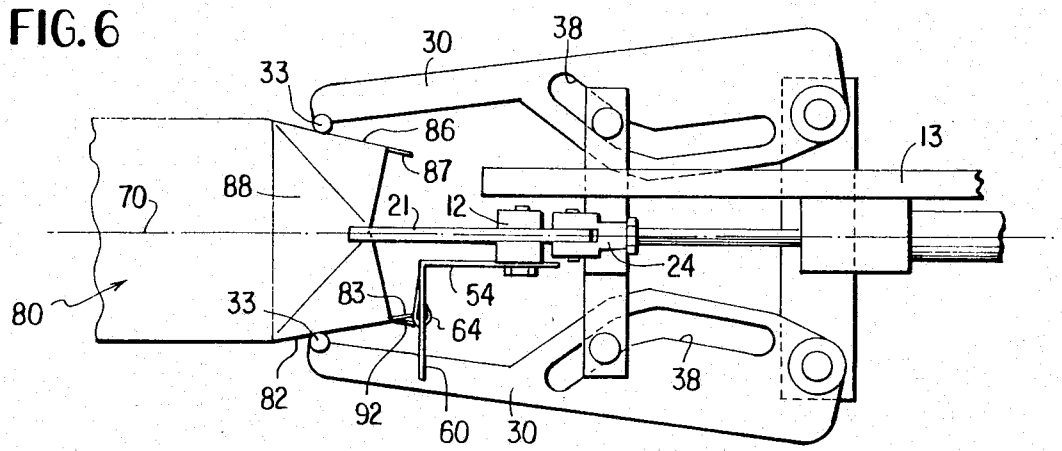

FIGS. 4 through 6 further illustrate the tab bottom prebreaking action.

At FIG. 4, the carton, the tab prebreaker, the bottom prebreaking apparatus are shown in a position just prior to the engagement of the four bottom forming flaps by rods 33 and finger elements 21. For ease in visualization, the full extent of finger elements 21 is not shown at FIG. 4, the same being true with respect to FIG. 6. At this point in time, the free end 83 of flap 82 is about to abut bracket leg portion 60, to initially assist in positioning the bottom flap folding operation. This is in itself conventional and has been previously described. At FIG. 5 the motion has continued until the four bottom forming flaps 82, 86 and 84, 88 have been pairwise contacted by, respectively, rods 33 and finger elements 21 to partially close in preparation for forming the container bottom end. At FIG. 6, the motion has continued further until such time as tab 92 has contacted abutment 64 to fold and break away the tab from its flap 82. The tab 92 is now out of the plane of the flap 82 and beyond the free edge 83 of the latter. Tab 92 is now at an angle of between 30 degrees and 45 degrees with flap 82.

Figure 7:
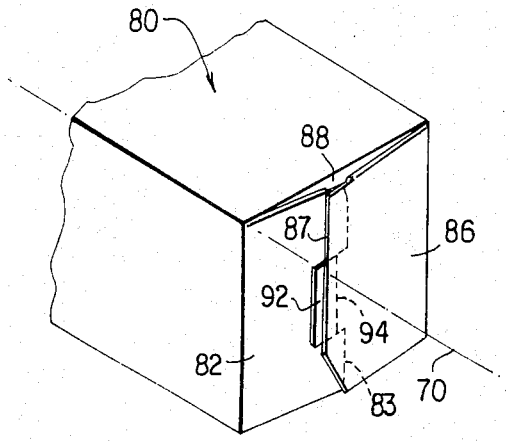
FIG. 7 is a view showing a tab-bottom container just prior to the completion of its bottom formation.
Figure 8:
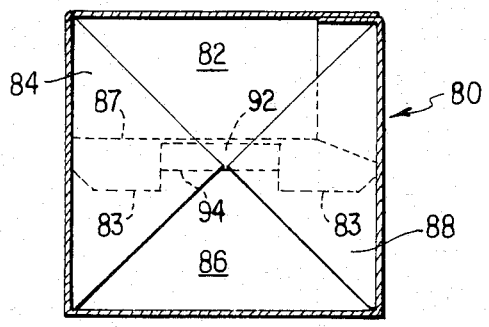
FIG. 8 is a view looking from the inside of the completed tab sealing container towards the bottom.

Subsequent to the completion of the tab prebreaking steps depicted in FIGS. 4 to 6, the carton 80 is moved to other stations. At these downstream stations, the tab-broken containers are subjected to conventional steps such as heating and further bottom flap bending to form their bottoms. FIG. 7 indicates the bottom formation just prior to the completion of the bottom, while FIG. 8 shows the completed tab bottom construction, with the folded pivot portion 94 of tab 92 being (partially) in communication with the container interior. The provision and folding of tab 92 prevents wicking, and is well known in the art. The reader will understand that the steps which result in the almost finished container bottom of FIG. 7 and the finished container bottom of FIG. 8 do not occur at the station where the tab-breaking (FIGS. 4–6) is carried out.

The tab prebreaking operation has thus been carried out in two stages. In the first stage, the tab 92 strikes abutment 64 and, with continued movement of flap 82, attains a position of about 30 degrees to 45 degrees from its flap 82. At other apparatus, later in time, the tab 92 is contacted by the free edge 87 of flap 86 to fold it back to its final position, substantially 180 degrees from its initial position.

The invention may be carried out with other bottom prebreaking apparatus. It is only necessary to place an abutment, such as curved abutment 64 of bracket 52, in the path of the sealing tab 92 so that the latter breaks away from the flap from which it is formed during bottom prebreaking.

Generally speaking, the present invention is directed to a bottom end closure forming apparatus and method for a container having two opposed pairs of bottom closing and forming flaps which are folded towards each other to define the container bottom. One bottom end defining flap has an integral tab positioned along one free edge thereof, the free edge of the tab carrying flap being received by a mouth defined by both its opposite and its two adjacent flaps. The tab is defined by two spaced cuts extending from the free edge of the tab flap, the tab initially lying in the plane of the flap from which it is formed. The tab is foldable about a fold line defined by the connection of the tab with the remainder of the tab flap. The apparatus includes means for positioning a container having bottom flaps which are to be folded from an initial position to form a container bottom, the apparatus also includes means for folding the tab flap towards its bottom forming position. Also included are means for forming an abutment positioned in the path of the tab as its respective tab flap swings towards its bottom forming position from an initial position, whereby the tab is broken out from the plane of its flap.

To prevent exposure of the raw edge of the fifth panel of carton 80 to the carton contents, the fifth panel may be skived as taught in U.S. Pat. Nos. 3,495,507; 3,604,613; and 3,654,842, all of which are incorporated herein by reference.

What is claimed is:

1. A bottom end closure pre-breaking apparatus for a container having two opposed pairs of bottom closing and forming flaps which are folded towards each other to define the container bottom, one bottom end defining flap having an integral tab positioned along one free edge thereof, the free edge of said tab carrying flap being received by a mouth defined by both its opposite and its two adjacent flaps, the said tab defined by two spaced cuts extending from the free edge of said tab flap, the tab initially lying in the plane of the flap from which it is formed, the tab being foldable about a fold line defined by the connection of the tab with the remainder of the tab flap, the apparatus including means for positioning a container having bottom flaps which are to be folded from an initial position to form a container bottom, said apparatus also including means for folding said tab flap towards its bottom forming position, the improvement comprising, means forming an abutment positioned in the path of the tab as its respective tab flap swings towards its bottom forming position from an initial position, whereby said tab is broken out from the plane of its flap and towards its bottom forming position, the mouth subsequently receiving the tab and its flap to fold the tab back against its flap to thereby form a container bottom having no raw paperboard edges through which wicking would occur, said abutment means comprising a bracket, said bracket having two legs at an angle to each other, the first leg having an aperture extending therethrough for the reception of a fastening element, the second leg including a curved abutment portion and a planar abutment portion, the curved abutment portion adapted to strike said tab out of the plane of the flap from which it is formed, the planar abutment adapted to abut a free end of a bottom flap and thereby assist in positioning a carton on a bottom forming machine.

2. The apparatus of claim 1 wherein said means for forming an abutment is of sheet material.

3. The apparatus of claim 1 wherein one part of the curved abutment portion of the bracket lies on one side of the plane of the planar abutment portion and another part of the curved abutment portion of the bracket lies on the other side of the plane of the planar abutment portion.

4. The apparatus of claim 1 wherein the two legs of the bracket are at an angle of substantially 90 degrees to each other.

5. The apparatus of claim 1 wherein the curved and planar abutment portions of the second leg of the bracket are separate from each other except at their respective junctions with the first leg.

6. A tab breaking abutment bracket for use with automatic paperboard carton setting up and bottom forming machinery, the bracket formed of rigid sheet material and having two legs, the first leg having an aperture extending therethrough for the reception of a fastening element, the second leg including a curved abutment portion and a planar abutment portion, the curved abutment portion adapted to strike a sealing tab out of the plane of its bottom forming carton flap from which it is formed, the planar abutment adapted to abut a free end of a bottom forming carton flap and thereby assist in positioning a carton on a bottom forming machine.

7. The bracket of claim 6 wherein one part of the curved abutment portion lies on one side of the plane of the planar abutment portion and another part of the curved abutment portion lies on the other side of the plane of the planar abutment portion.

8. The bracket of claim 6 or 7 wherein the two legs are at substantially 90 degrees to each other.

9. The bracket of claim 6 or 7 wherein the curved and planar abutment portions of the second leg of the bracket are separate from each other except at their respective junctions with the first leg.

* * * * *